US006187156B1

(12) United States Patent
Virtanen et al.

(10) Patent No.: US 6,187,156 B1
(45) Date of Patent: Feb. 13, 2001

(54) ANODE FOR ELECTROLYTIC REFINING

(75) Inventors: Henri Virtanen; Ismo Virtanen, both of Pori; Tuomo Kivistö ; Tom Marttila, both of Kirkkonummi, all of (FI)

(73) Assignee: Outokumpu OYJ, Espoo (FI)

( * ) Notice: Under 35 U.S.C. 154(b), the term of this patent shall be extended for 0 days.

(21) Appl. No.: 09/445,295

(22) PCT Filed: Jun. 5, 1998

(86) PCT No.: PCT/FI98/00485

§ 371 Date: Dec. 2, 1999

§ 102(e) Date: Dec. 2, 1999

(87) PCT Pub. No.: WO98/58101

PCT Pub. Date: Dec. 23, 1998

(30) Foreign Application Priority Data

Jun. 18, 1997 (FI) ..... 972610

(51) Int. Cl.[7] ..... C25D 1/00; C25B 11/00
(52) U.S. Cl. ..... 204/281; 204/288
(58) Field of Search ..... 204/281, 288; 205/292

(56) References Cited

U.S. PATENT DOCUMENTS

| | | | | |
|---|---|---|---|---|
| 3,883,403 | * | 5/1975 | Ettel et al. | 204/281 |
| 4,015,099 | | 3/1977 | Seniuk et al. | 219/118 |
| 4,209,379 | | 6/1980 | Freeman et al. | 204/198 |
| 4,490,223 | | 12/1984 | Baldwin | 204/106 |

FOREIGN PATENT DOCUMENTS

| | | |
|---|---|---|
| 1 234 780 | 4/1988 | (CA) . |
| 35 14 963 | 3/1986 | (DE) . |
| 0 286 093 | 10/1988 | (EP) . |

* cited by examiner

*Primary Examiner*—Bruce F. Bell
(74) *Attorney, Agent, or Firm*—Smith-Hill and Bedell

(57) ABSTRACT

The invention relates to an anode used in the electrolytic refining of copper, said anode (1) comprising two support parts (2), whereby the anode (1) is suspended during the electrolytic process against the electrolytic tank walls. According to the invention, in the anode support parts (2) there are formed brackets (3) for gripping the anode (1) and for supporting the anode (1) when it is being transferred from one position to another.

4 Claims, 1 Drawing Sheet

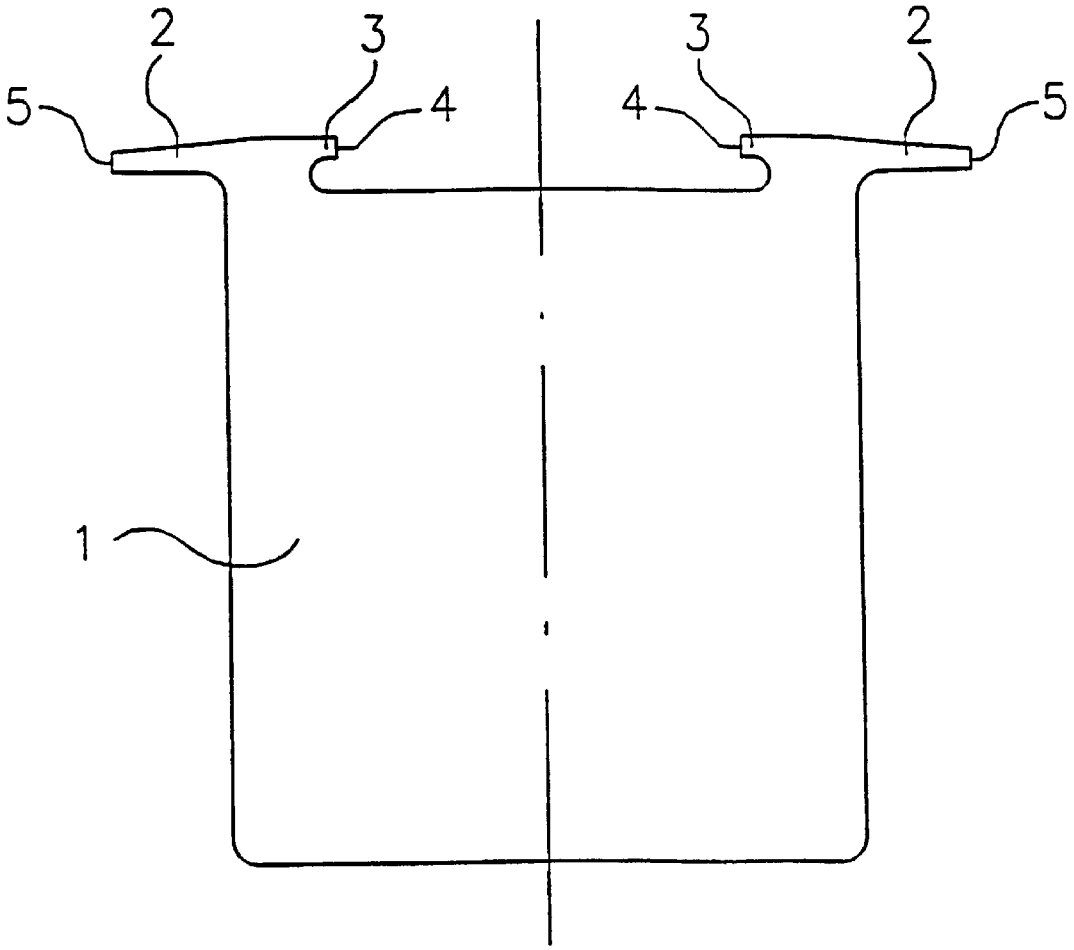
2
3
3
2
5
4
4
5
1

ANODE FOR ELECTROLYTIC REFINING

The present invention relates to a soluble copper anode for electrolytic refining, which anode is immersed in a tank used in electrolytic refining and lifted up from said tank, so that the gripping members provided in the charging member are protected from getting into contact with the tank walls.

The cathodes and anodes serving as electrodes in the electrolytic refining of copper are placed in an alternating fashion in a tank containing the electrolytic solution. In order to advantageously perform electrolytic refining, the electrodes are positioned as near to each other as possible, and the mutual positioning of the electrodes must be carried out as precisely as possible in order to avoid short circuits. Although the anodes and cathodes are subjected to completely different operations both before their immersion in the electrolytic tank and after being lifted up therefrom, it is advantageous for the operation of the charging member that the charging member, while being positioned above the electrolytic tank, can handle both anodes and cathodes at the same time. Therefore the charging member is advantageously provided with separate gripping members designed for anodes and cathodes respectively.

When using an anode that is soluble in the electrolytic solution, the anode lugs that support the anode both during loading and during the electronic treatment are made of the same soluble material, and therefore the anode lugs are made as short as possible. Thus the anode gripping members in connection with loading extend essentially near to the tank walls and to the conductor rails with insulation suspended from the tank walls, in which case even slight erroneous movements of the gripping member could result in the damaging of the tanks, conductor rails or insulation.

When using copper anodes of the conventional shape, where the grip point between the lugs and the charging member is located in between the electrolytic tank wall and the plate-like part of the anode, the surface of the electrolytic solution contained in the electrolytic tank must be essentially low with respect to the conductor rails suspended from the tank walls, so that the anode lug designs required by the anode treatment are prevented from entering the electrolytic solution and thus from interfering the electrolytic process itself. When the surface of the electrolytic solution is kept low, the investment and running expenses of the electrolytic plant are increased—owing to an increased amount of anode scrap, among other reasons.

SUMMARY OF THE INVENTION

The object of the present invention is to eliminate some of the drawbacks of the prior art and to realize and improved and more feasible soluble anode designed for the electrolytic refining of copper, in which anode the grip point in between the anode lug and the charging member is adjusted in order to be able to load both the anodes and the cathodes used in electrolytic refining in an essentially simultaneous fashion. The essential novel features of the invention are apparent from the appended claims.

In the soluble anode meant for the electrolytic refining of copper, in the suspension part of the anode, which suspends the anode in the electrolytic tank during the electrolytic process, there is formed, advantageously when casting the anode, a bracket, so that the end of said bracket that points away from the anode suspension part is directed towards the center line of the anode or towards an imaginary continuation of said center line. Thus the suspension part of an anode that is provided with a bracket can be thoroughly gripped above the liquid surface of the electrolytic solution contained in the electrolytic tank—and by using a motion of the gripping member that takes place essentially far from the electrolytic tank walls. According to the invention, the bracket formed in the anode suspension part supports the anode during transportation to the electrolytic tank, during the immersion into and lifting up from the electrolytic tank, and during further transportation away from the electrolytic tank. Thus the support part proper supports the anode only while the anode is being immersed in the electrolytic tank.

Because the electrodes, the cathodes and anodes, used in the electrolytic refining of copper carried out in an electrolytic tank, are during the electrolytic process suspended from the electrolytic tank walls by means of two separate support parts that are located on opposite sides of the center line of the electrodes, in the anode according to the present invention the grip bracket is likewise formed separately for both support parts, advantageously so that the bracket ends directed away from the support part are pointed towards each other.

According to the invention, the bracket formed in the anode support part is advantageously positioned so that the bracket end directed away from the support part is located essentially at the same height as that end of the support part that points away from the center line of the anode. Now the bracket is advantageously essentially parallel with the support part along the whole length thereof. That end of the bracket that points away from the support part may also be located at a different height, either higher or lower, than the end that is directed away from the anode center line. In that case at least part of the bracket forms a sharp angle in relation to the support part. The length of the bracket is advantageously such that a sufficient support is obtained by means of the gripping member provided in the charging member in order to transfer the anode from one position to another. Moreover, the brackets provided in the support parts of an anode according to the invention are located so that the brackets are positioned essentially symmetrically with respect to the anode center line.

When employing a soluble anode meant for electrolytic refining according to the invention, where the support part of said anode is provided with a bracket for suspending the anode in connection with transportation, it is essentially easy to handle mixed anode and cathode loads with a charging member, because the gripping members provided in the charging member and matching the bracket do not need to penetrate in between the anodes and cathodes, where there is usually no room for the anode gripping member. In addition, a bracketed anode according to the invention can be gripped so that the location of the anode with respect to the gripping member can be adjusted in an essentially precise fashion. Moreover, the gripping member gripping the bracket is placed essentially far from the electrolytic tank walls and from the conductor rails with insulation provided on the walls, so that the gripping member does not hit the walls or rails, at least not due to slight erroneous movements.

Advantageously the bracket formed in the anode grip part according to the invention and the gripping member that grips said bracket are always positioned above the electrolytic solution contained in the electrolytic tank, so that the treatment of the anode according to the invention does not in any way restrict a possible raising of the surface of the electrolytic solution. By raising the surface of the electrolytic solution, the investment and running costs of an electrolytic refining plant can be advantageously cut. Thus for instance the amount of anode scrap is reduced, irrespective of separate grip brackets. Moreover, when a grip bracket is used in the anode grip part according to the invention, the gripping of the anode need not be taken into account while defining the respective dimensions of the electrolytic tank and the cathodes and anodes serving as electrodes.

BRIEF DESCRIPTION OF THE DRAWING

The invention is explained in more detail below, with reference to the appended drawing, which is a front-view illustration of a preferred embodiment of the invention.

DETAILED DESCRIPTION OF THE INVENTION

According to the drawing, in a cast copper anode 1, there are formed, in connection with the casting, support parts 2 in order to suspend the anode during the dissolution process taking place in the electrolytic tank. Moreover, in connection with the casting, the support parts 2 are provided with grip brackets 3 in order to support the anode while the anode is being moved by means of gripping members (not illustrated) that are connected to the charging member and are known as such. In addition to this, the reference number 4 refers to that end of the grip bracket 3 that points away from the support part, and the reference number 5 refers to that end of the support part 2 that points away from the anode.

What is claimed is:

1. An anode for the electrolytic refining of copper, said anode (1) containing two support parts (2), by which the anode (1) can be suspended during the electrolytic process against the electrolytic tank walls, characterized in that when casting the anode (1), in the anode support parts (2), there are formed brackets (3) for gripping the anode (1) and for supporting the anode (1) when transferring it from one position to another, so that the end (4) of the bracket (3) that points away from the support part is located essentially at the same height as the end (5) of the support part (2) that points away from the anode.

2. An anode according to claim 1, characterized in that the bracket (3) is formed so that the end (4) of the bracket (3) that points away from the support part is directed towards the end (4) of the bracket that is located in the second support part (2) of the anode and points away from that.

3. An anode according to claim 1, characterized in that the bracket (3) is essentially parallel to the support part (2) along the whole length thereof.

4. An anode according to claim 1, characterized in that the brackets (3) formed in the support parts (2) are in an essentially symmetrical position with respect to the center line of the anode 1.

* * * * *